US008690042B2

(12) United States Patent
Wawrzyniak et al.

(10) Patent No.: US 8,690,042 B2
(45) Date of Patent: Apr. 8, 2014

(54) ENVELOPE ASSEMBLY

(75) Inventors: Amanda Wawrzyniak, South Elgin, IL (US); Todd Davis, Marengo, IL (US)

(73) Assignee: Continental Datalabel, Inc., Elgin, IL (US)

( * ) Notice: Subject to any disclaimer, the term of this patent is extended or adjusted under 35 U.S.C. 154(b) by 95 days.

(21) Appl. No.: 13/301,420

(22) Filed: Nov. 21, 2011
(Under 37 CFR 1.47)

(65) Prior Publication Data

US 2012/0132698 A1 May 31, 2012

Related U.S. Application Data

(63) Continuation of application No. 11/820,732, filed on Jun. 20, 2007, now abandoned.

(60) Provisional application No. 60/815,045, filed on Jun. 20, 2006.

(51) Int. Cl.
*B65D 27/04* (2006.01)

(52) U.S. Cl.
USPC ..... 229/71; 229/72; 229/75; 40/124.06; 40/124.09

(58) Field of Classification Search
USPC ..... 229/71, 72, 75, 80.5; 40/124.06, 124.09
See application file for complete search history.

(56) References Cited

U.S. PATENT DOCUMENTS 828,989 A 8/1906 Ward
886,350 A 5/1908 Corliss
1,025,937 A 5/1912 Von Vargyas et al.
1,304,877 A 5/1919 Heywood
1,434,097 A 10/1922 Conner
1,476,495 A 12/1923 Cross
1,523,291 A 1/1925 Ritter
2,033,994 A 3/1936 Mulligan
2,067,948 A 1/1937 Potdevin
2,108,343 A 2/1938 McAllister
2,135,865 A 11/1938 Winokar
2,219,526 A 10/1940 McLaren
3,237,327 A * 3/1966 Griggs ..... 40/643
3,314,592 A 4/1967 Streich
3,327,416 A 6/1967 Sanford
3,369,732 A 2/1968 Hanson
3,489,332 A * 1/1970 Knittel ..... 229/80
4,579,277 A 4/1986 Gendron
5,255,785 A 10/1993 Mackey
5,267,687 A 12/1993 Sherman
5,397,427 A 3/1995 Traise et al.
5,579,908 A 12/1996 Johnson
5,624,069 A 4/1997 Coats et al.

(Continued)

*Primary Examiner* — Jes F Pascua
*Assistant Examiner* — Peter Helvey
(74) *Attorney, Agent, or Firm* — Pauley Petersen & Erickson

(57) ABSTRACT

An assembly including a front panel is separated from a back panel by a panel fold line. Side flaps are disposed at opposing edges of the front panel and are each separated from the front panel by a flap fold line. The side flaps include a front flap surface with an adhesive material and a back flap surface opposite the front flap surface. The assembly is foldable about the panel fold line to dispose the back panel adjacent the front panel and foldable about the flap fold line to dispose the back flap surface adjacent a front surface of the back panel when the back panel is folded. In a folded position, the assembly forms a pocket between the front and back panels, and is adherable by the adhesive material to a separate surface.

11 Claims, 3 Drawing Sheets

(56) References Cited

U.S. PATENT DOCUMENTS

| | | | | |
|---|---|---|---|---|
| 5,687,903 | A | 11/1997 | Akridge et al. | |
| 5,737,775 | A | 4/1998 | Schwartz | |
| 5,794,409 | A * | 8/1998 | Akridge et al. | 53/460 |
| 5,845,772 | A | 12/1998 | Cieplak | |
| 6,131,802 | A | 10/2000 | Lombardo | |
| 6,220,504 | B1 | 4/2001 | Flynn et al. | |
| 6,279,817 | B1 | 8/2001 | Flynn et al. | |
| 6,352,198 | B1 | 3/2002 | Flynn et al. | |
| 6,367,689 | B1 | 4/2002 | Flynn et al. | |
| 6,402,015 | B1 | 6/2002 | Collins | |
| 6,427,905 | B1 | 8/2002 | Flynn et al. | |
| 6,446,374 | B1 * | 9/2002 | Ardiff | 40/593 |
| 6,446,375 | B1 | 9/2002 | Davis | |
| 6,488,999 | B1 | 12/2002 | Flynn et al. | |
| 6,499,652 | B1 | 12/2002 | Flynn et al. | |
| 6,523,737 | B1 | 2/2003 | Flynn et al. | |
| 6,644,538 | B1 | 11/2003 | Schnitzer | |
| 6,673,408 | B1 | 1/2004 | Roth | |
| 6,725,587 | B2 | 4/2004 | Collins | |
| 7,172,107 | B2 | 2/2007 | Kranz | |
| 7,647,715 | B2 * | 1/2010 | Caravacci et al. | 40/124.06 |
| 7,712,644 | B2 | 5/2010 | Rafalowitz et al. | |
| 2003/0059751 | A1 * | 3/2003 | Welles | 434/238 |
| 2008/0116248 | A1 | 5/2008 | Wawrzyniak et al. | |

* cited by examiner

ENVELOPE ASSEMBLY

CROSS REFERENCE TO RELATED APPLICATION

This patent application is a Continuation of U.S. patent application Ser. No. 11/820,732, filed 20 Jun. 2007, which claims the benefit of U.S. Provisional Patent Application Ser. No. 60/815,045, filed on 20 Jun. 2006. The co-pending Parent patent application is hereby incorporated by reference herein in its entirety and is made a part hereof, including but not limited to those portions which specifically appear hereinafter.

BACKGROUND OF THE INVENTION

This invention is directed to an envelope, or an envelope assembly, that can be adhered to another surface. The envelope assembly is assembled by the end user, such as by folding along provided fold lines.

SUMMARY OF THE INVENTION

A general object of the invention is to provide an improved envelope that can be printed on, such as using a printer operatively connected to a computer, and folded and adhered to a surface, all by a consumer.

The general object of the invention can be attained, at least in part, through an assembly. The assembly includes a sheet of material defining a front panel, a back panel, and a side flap. The front panel is separated from the back panel by a panel fold line. Each of the front and back panels includes a front panel surface and a back panel surface opposite the front panel surface. The side flap is disposed at an edge of the front panel and separated from the front panel by a flap fold line. The side flap includes a front flap surface with an adhesive material and a back flap surface opposite the front flap surface. A removable sheet is disposed over the adhesive material. The assembly is foldable about the panel fold line to dispose the back panel adjacent the back surface of the front panel. The assembly is foldable about the flap fold line to dispose the back flap surface adjacent the front surface of the back panel when the back panel is folded. In a folded position, the assembly forms a pocket between the front and back panels, and is adherable by the adhesive material to a separate surface.

The invention further comprehends a method of forming an adherable pocket assembly from the assembly of this invention. The method includes folding the assembly along the panel fold line to dispose the back panel adjacent the front panel back surface, and folding the assembly along the flap fold line to dispose the flap back surface adjacent the front surface of the back panel. The folding forms a folded assembly and the removable sheet can be removed to expose the adhesive material and the folded assembly adhered to a surface.

The invention still further comprehends an envelope. The envelope includes a front panel with a front panel surface and a back panel surface opposite the front panel surface. A back panel is adjacent the front panel back surface and attached to the front panel at a panel fold line. A first side flap is attached by a first flap fold line to a first side edge of the front panel. The first side flap includes a first flap surface with an adhesive material and a second flap surface opposite the first flap surface. The first side flap is folded about the first flap fold line and the second flap surface is disposed adjacent to the back panel.

The invention still further comprehends an assembly. The assembly includes a sheet of material defining a front panel, a back panel, and two side flaps. The front panel is separated from the back panel by a panel fold line. Each of the two side flaps is disposed near one of opposing edges of the front panel and separated from the front panel by a flap fold line. Each of the two side flaps includes a front flap surface with an adhesive material and a back flap surface opposite the front flap surface. A removable sheet is disposed over the adhesive material. The assembly is foldable about the panel fold line to dispose a surface of the back panel adjacent a surface of the front panel. The assembly is foldable about the flap fold line to hold the back panel adjacent the front panel. In a folded position, the assembly forms a pocket between the front and back panels and is adherable by the adhesive material to a separate surface.

BRIEF DESCRIPTION OF THE DRAWINGS

These and other objects and features of this invention will be better understood from the following detailed description taken in conjunction with the drawings, wherein:

FIG. 1 illustrates the envelope assembly in a pre-assembled state. FIG. 2 is a front view of the envelope assembly in an assembled state. FIG. 3 is a rear view of the envelope assembly in an assembled state.

DESCRIPTION OF THE DRAWINGS

In one embodiment of this invention, an assembly includes a sheet of material defining a front panel, a back panel, and two side flaps. A panel fold line separates the front panel from the back panel. Each of the two side flaps is disposed at or near opposing edges of the front panel, and is separated from the front panel by a flap fold line. Each of the two side flaps includes a front flap surface with an adhesive material, and a back flap surface opposite the front flap surface. The adhesive material can include any suitable adhesive known and available to those skilled in the art, such as, for example, adhesives currently used for forming pressure sensitive, or self-adhesive labels. A removable sheet is disposed over the adhesive material. The assembly is foldable about the panel fold line to dispose a surface of the back panel adjacent a surface of the front panel. The assembly is further foldable about the flap fold line to dispose the back flap surfaces against the folded back panel to hold the back panel adjacent the front panel. In the folded position, the assembly is adherable by the folded flaps to a separate surface to secure a pocket between the front and back panels. The pocket includes an open end opposite the folded panel fold line, and is closed at opposing sides by the folded and adhered flaps.

Figure 1:
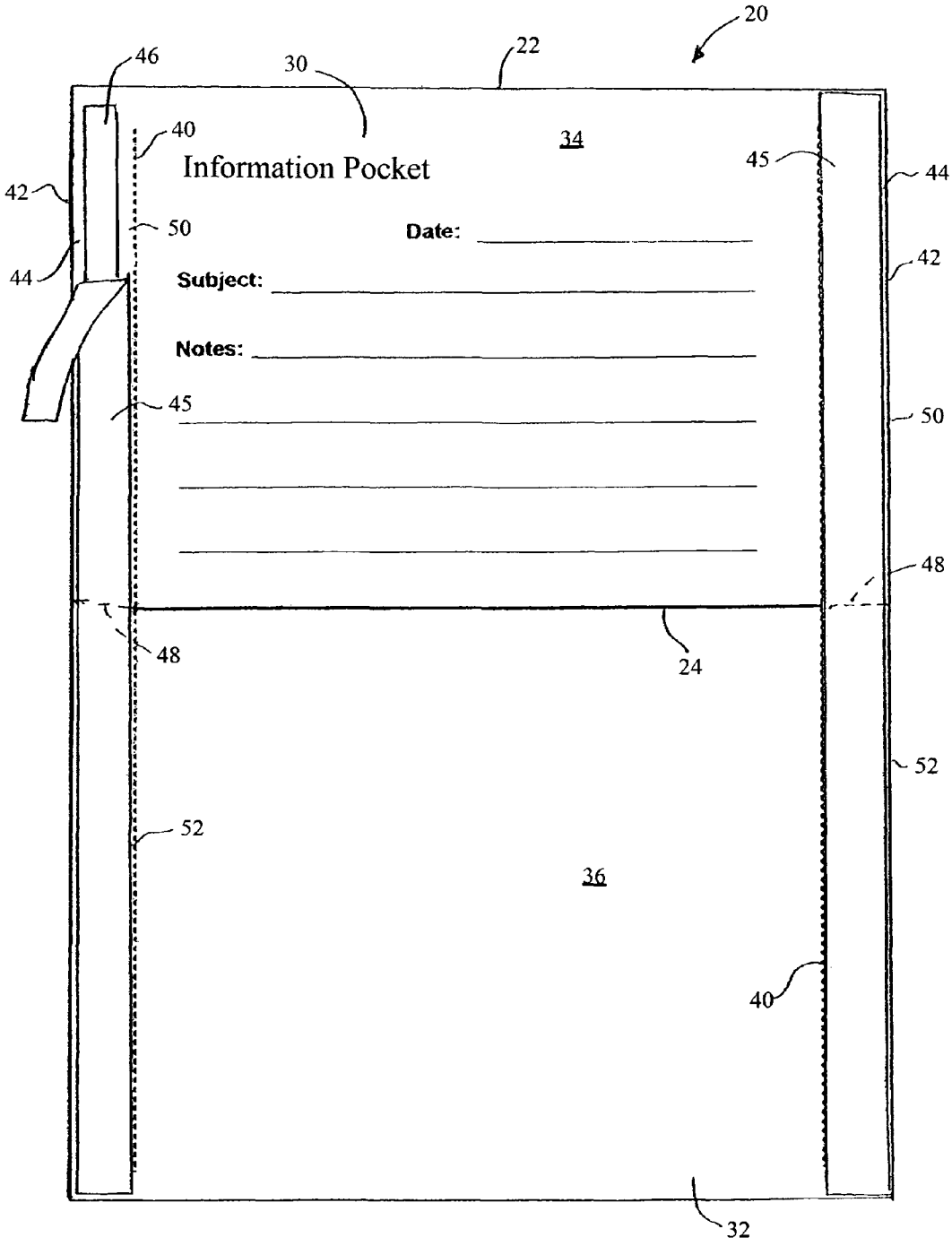
FIGS. 1-3 illustrate an envelope assembly according to one embodiment of this invention.

FIG. 1 illustrates an envelope assembly 20 in a pre-assembled state according to one embodiment of this invention. The envelope assembly 20 includes a planar sheet 22. The planar sheet is divided by a panel fold line 24 to define a front panel 30 and a back panel 32. The front panel 30 includes a front panel front surface 34 and a front panel back surface (not shown) on a side of the front panel 30 opposite the front panel front surface 34. Similarly, the back panel 32 includes a back panel front surface 36 and a back panel back surface 38 (shown in FIG. 2) on a side of the back panel 32 opposite the back panel front surface 36. The front panel front surface 34 desirably includes a printed and/or printable surface.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention.

The sheet 22 is of any suitable shape, and generally any suitable size, such as that which can be accepted by and fed through a printer, such as a laser printer or an ink jet printer. The sheet 22 is preferably, but not necessarily, constructed of any suitable paper, paper composite, non-metal and/or metal material that can be used as a label. Other suitable materials for constructing the sheet 22 include fabric, plastic, and metal foils.

The sheet 22, and the printable surface, can be any of a variety of materials, such as those used to make pressure sensitive, or self-adhesive labels. Such materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The planar sheet 22 also includes two flap fold lines 40, each extending at an angle to the panel fold line 24 and defining two opposing side flaps 42 at opposing side edges of the front panel 30 and, in the embodiment of FIG. 1, the back panel 32. Each of the two side flaps 42 include a front flap surface 44 with an adhesive material 46, such as, without limitation, a double-sided tape, applied thereon and a back flap surface (not shown) on an opposite side from the front flap surface 44. A removable sheet 45 is disposed over the adhesive material, until the sheet 45 is removed by the user just prior to use. The removable sheet 45 is desirably formed of a material to which the adhesive material 46 adheres significantly less than to the sheet 22, such as is known for forming pressure sensitive, or self-adhesive labels.

In one embodiment of the invention, as shown in FIG. 1, the side flaps 42 include a tearable line of separation 48, such as formed by perforations across the side flaps 42, aligned with, and desirably an extension of, the panel fold line 24. The tearable line 48 divides the side flaps 42 into two portions, shown in FIGS. 1-3 as front panel side flap portions 50 and back panel side flap portions 52. In another alternative embodiment of the invention, the side flaps extend only adjacent the front panel 30, or the back panel side flap portions 52 are removable, such as by being perforated along the portion of the flap fold line 40 adjacent the back panel 32.

Figure 2:
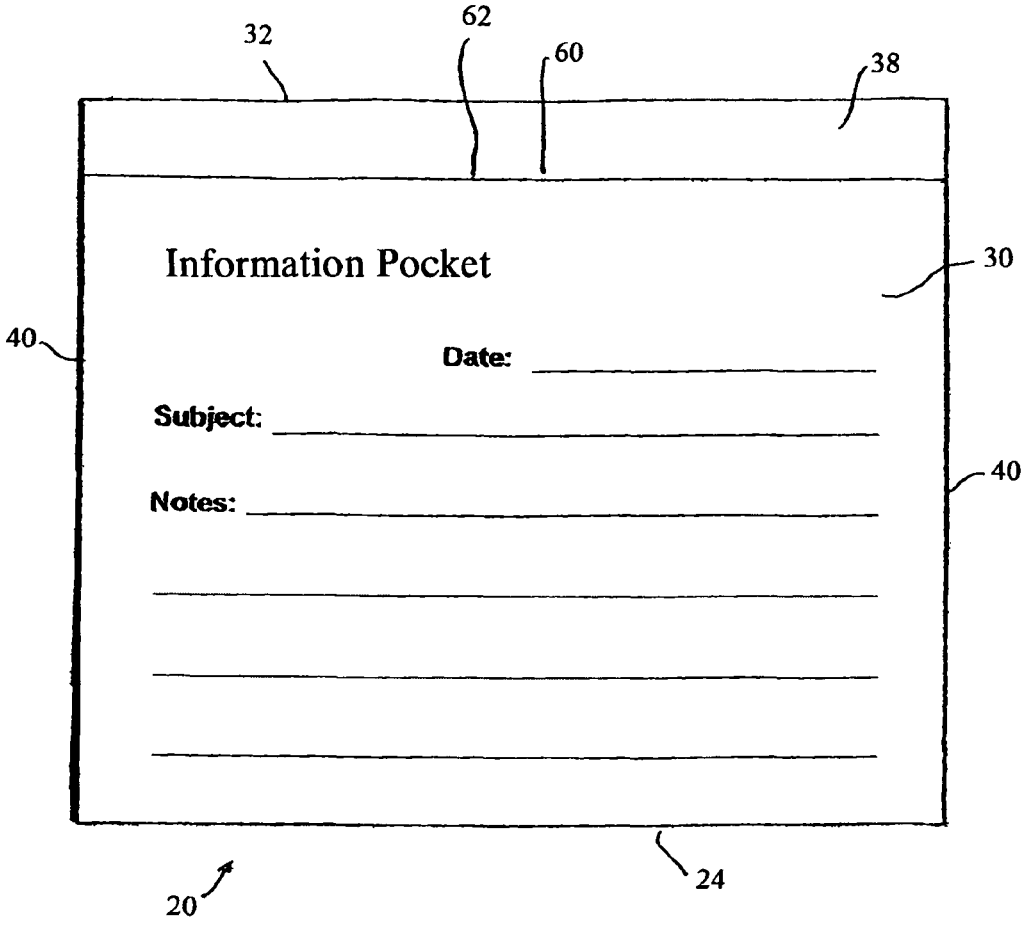
Figure 3:
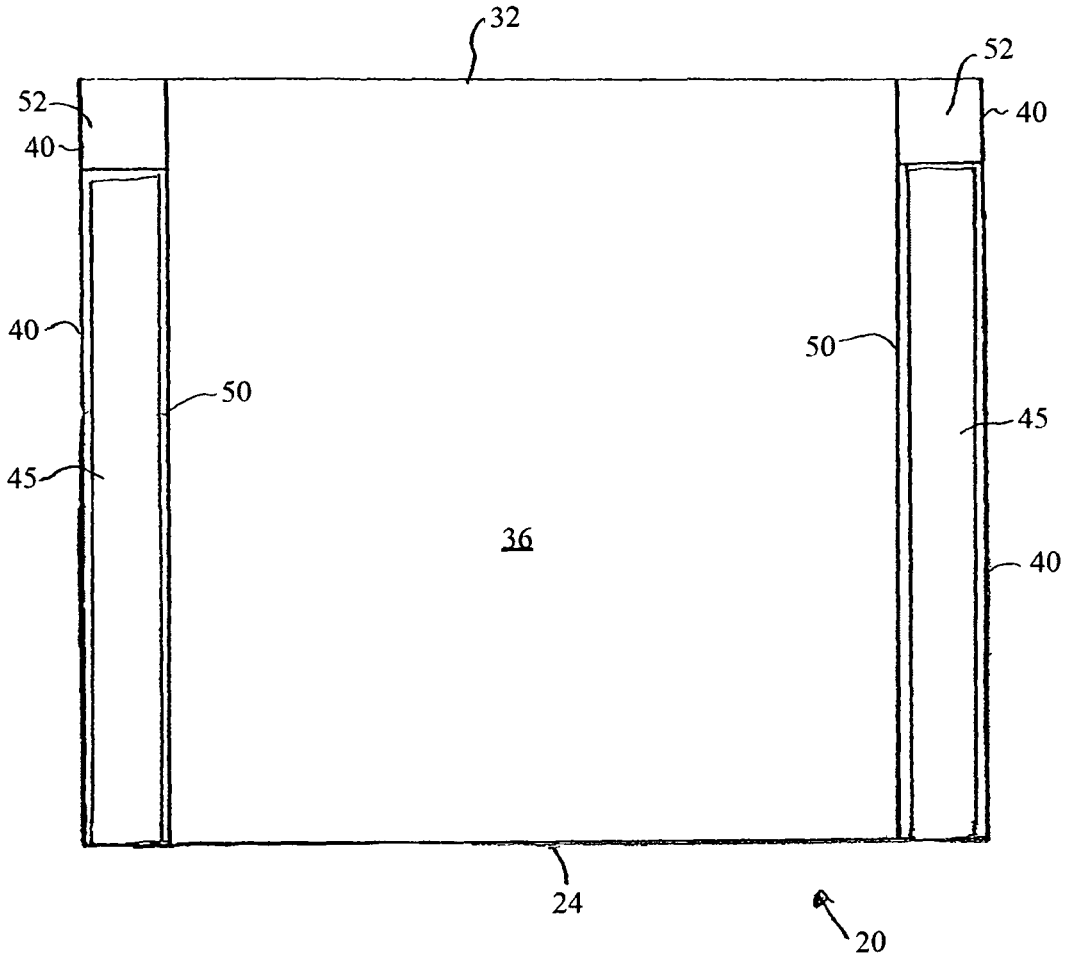

The assembly 20 is foldable to form an envelope as shown in FIGS. 2 and 3. In the embodiment shown in FIGS. 1-3, the tearable line 48 is torn to divide the side flaps 40 into the front panel side flap portions 50 and the back panel side flap portions 52. As shown in FIG. 3, the back panel side flap portions 52 are desirably folded such that the adhesive 46 (removable sheet 45 removed) contacts the back panel front surface 36. As shown in FIGS. 2 and 3, the sheet 22 is folded about the panel fold line 24 to dispose the back panel back surface 38 adjacent to the front panel back surface (not shown). In the embodiment of the invention shown in FIGS. 1-3, the back panel 32 is larger than the front panel 30, and extends above the front panel 30 in the folded state shown in FIG. 2. The front panel side flap portions 50 are folded about the flap fold line 40 and over the back panel 32 to hold the back panel 32 adjacent the front panel 30.

As shown in FIG. 3, the adhesive coated front panel side flap portions 50 are disposed toward the rear of the envelope. The removable sheet portions 45 can be removed (if they were not already during folding), and the folded envelope assembly 20 is adherable to a separate surface by the adhesive 46. A pocket 60 is formed between the front panel 30 and the back panel 32. As shown in FIG. 2, the pocket 60 includes an open end or opening 62 opposite the folded panel fold line 24. The pocket 60 is closed at opposing sides by the folded front panel side flap portions 50. By adhering, the folded front panel side flap portions 50 to a surface, the envelope 20 is secured or held in the folded state.

Various and alternative size, shapes and configurations are available for the fold lines (e.g., panel and flap fold lines) of this invention. In the embodiment shown in FIGS. 1-3, the fold lines are desirably printed on the sheet 22 as a folding guide for the user. In another embodiment of this invention, the fold lines include a score line or perforations that desirably facilitate folding along the fold lines.

Thus, the invention provides an envelope assembly that can be printed on and folded by the consumer into a folded use state. The envelope can be adhered to various surfaces to provide an envelope fixed to those surfaces.

It will be appreciated that details of the foregoing embodiment, given for purposes of illustration, are not to be construed as limiting the scope of this invention. Although only an exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A method of forming an adherable pocket assembly from an envelope assembly, the envelope assembly including a sheet of material defining a front panel, a back panel, a side flap, and a second side flap, the front panel separated from the back panel by a panel fold line, each of the front and back panels including a front panel surface and a back panel surface opposite the front panel surface, the side flap extending along an edge of the front panel and separated from the front panel by a flap fold line, the second side flap extending along a second edge of the front panel and separated from the front panel by a second flap fold line, each of the side flap and the second side flap including a front flap surface with an adhesive material and a back flap surface opposite the front flap surface, and a removable sheet disposed over the adhesive material, wherein each of the side flap and the second side flap extends along the front and back panel and includes a tearable line of separation aligned with the panel fold line, the method comprising:

separating the tearable lines of separation for each of the side flap and the second side flap to form front panel side flap portions and back panel side flap portions;

folding the back panel side flap portions against the back panel surface of the back panel;

folding the assembly along the panel fold line to dispose the back panel adjacent the front panel back surface, wherein upon folding the assembly along the flap fold line the back panel side flap portions are disposed between the front panel and the back panel; and folding the front panel side flap portions to dispose the back panel between the front panel and the front panel side flap portions, wherein the flap back surfaces of the front panel side flap portions are adjacent the front surface of the back panel when the back panel is folded.

2. The method of claim 1, wherein a portion of the panel fold line adjacent the back panel comprises perforations.

3. A method of forming an adherable pocket assembly from an envelope assembly, the envelope assembly including a sheet of material defining a front panel, a back panel, and a side flap, the front panel separated from the back panel by a panel fold line, each of the front and back panels including a front panel surface and a back panel surface opposite the front panel surface, the side flap extending along an edge of the front panel and the back panel and separated from the front panel and the back panel by a flap fold line, the side flap including a tearable line of separation aligned with the panel fold line, the side flap including a front flap surface with an adhesive material and a back flap surface opposite the front flap surface, and a removable sheet disposed over the adhesive material, the method comprising:

separating the tearable line of separations to form a front panel side flap portion and a back panel side flap portion;

folding the back panel side flap portion against the back panel surface of the back panel;

folding the assembly along the panel fold line to dispose the back panel adjacent the front panel back surface, wherein upon folding the assembly along the flap fold line the back panel side flap portion is disposed between the front panel and the back panel; and folding the assembly along the flap fold line to dispose the back panel between the front panel and the front panel side flap portion, wherein the flap back surface is adjacent the front surface of the back panel.

4. The method of claim 3, wherein in a folded configuration a pocket is formed between the front and back panels, and further comprising adhering the envelope assembly in the folded configuration by the adhesive material to a separate surface.

5. The method of claim 3, wherein the front panel surface comprises at least one of a printed surface and a printable surface.

6. The method of claim 3, wherein the sheet of material is selected from paper, paper composite, plastic, metal foil, and combinations thereof.

7. The method of claim 3, wherein the back panel is larger than the front panel and extends above the front panel in the folded state.

8. The method of claim 3, further comprising:

a second side flap disposed at a second edge of the front panel and separated from the front panel by a second flap fold line;

the second side flap including a front flap surface with an adhesive material and a back flap surface opposite the front flap surface;

a second removable sheet disposed over the adhesive material of the second side flap; and folding the second side flap about the second flap fold line to dispose the flap back surface of the second side flap adjacent the front surface of the back panel when the back panel is folded.

9. The method of claim 3, wherein the folding forms a folded assembly and further comprising:

removing the removable sheet to expose the adhesive material; and adhering the folded assembly to the separate surface.

10. A method of forming an envelope, comprising:

providing an envelope assembly including a sheet of material defining a front panel, a back panel, and two side flaps, the front panel separated from the back panel by a panel fold line, each of the two side flaps disposed near one of opposing edges of the front panel and separated from the front panel by a flap fold line, each of the two side flaps including a front flap surface with an adhesive material and a back flap surface opposite the front flap surface, and a removable sheet disposed over the adhesive material when the assembly is in a pre-folded arrangement, wherein the front panel comprises a printable surface and each of the two side flaps extends along the front and back panel and include a tearable line of separation aligned with the panel fold line;

folding the envelope assembly about the panel fold line to dispose a surface of the back panel adjacent a surface of the front panel;

folding the assembly about the flap fold line to place the back flap surface against the back panel to hold the back panel adjacent the front panel and between the front panel and the back flap surface;

removing the removable sheet to expose the adhesive material; and adhering the adhesive material to a separate surface, wherein the two side flaps are between the back panel and the surface, and the envelope assembly forms a pocket between the front and back panels.

11. The method of claim 3, further comprising adhering the back panel side flap to the front panel.

* * * * *